US006896163B2

(12) United States Patent
Louw

(10) Patent No.: US 6,896,163 B2
(45) Date of Patent: May 24, 2005

(54) PINCH-GRIP HANGER

(76) Inventor: Henry Louw, Dreyersdal Rd., Bergvliet 7800 (ZA)

( * ) Notice: Subject to any disclaimer, the term of this patent is extended or adjusted under 35 U.S.C. 154(b) by 0 days.

(21) Appl. No.: 10/118,122

(22) Filed: Apr. 4, 2002

(65) Prior Publication Data

US 2002/0145016 A1 Oct. 10, 2002

Related U.S. Application Data

(60) Provisional application No. 60/281,454, filed on Apr. 4, 2001.

(51) Int. Cl.[7] ..... A41D 27/22
(52) U.S. Cl. ..... 223/93
(58) Field of Search ..... 223/93, 85, 91, 223/96, 90

(56) References Cited

U.S. PATENT DOCUMENTS

| | | | |
|---|---|---|---|
| 549,145 | A | 11/1895 | Mickelson |
| 670,027 | A | 3/1901 | Malmberg |
| 1,081,058 | A | 12/1913 | Owens |
| 1,162,613 | A | 11/1915 | Kalina |
| 1,795,622 | A | 3/1931 | Taylor et al. |
| 1,893,508 | A | 1/1933 | Rosenberg |

(Continued)

*Primary Examiner*—John J. Calvert
*Assistant Examiner*—James G Smith
(74) *Attorney, Agent, or Firm*—Ostrolenk, Faber, Gerb & Soffen, LLP

(57) ABSTRACT

A pinch-grip hanger includes an elongated body with first and second pinch-grips positioned along the body. Each pinch-grip has a stationary back leg and a front leg movable about a pivot axis, with single gripping portions at the lower ends thereof. An inverted U-shaped spring applies a force near the lower ends of the legs to bias the gripping portions thereof toward each other. Moving the upper ends of the front leg rearwardly separates the gripping portions, thereby opening the pinch-grip. Spacers at opposite sides of the legs extend in the front-to-back direction a sufficient distance so that contact with another hanger on a rack will not move the upper ends of the legs toward each other a sufficient distance to release an item being held by the gripping portions. Opposed overlapping barriers extend from the front and back legs just below the pivot axis. These shield an item held by the hanger from the area near the pivot axis. The gripping portions each have a single gripping tooth, the tips of which are substantially in contact when the pinch grip is closed and an item is not being held by the hanger. The teeth have substantially planar parallel upper surfaces that together define the lower end of the gripping area between the gripping portions. The gripping portions also have outwardly tapering end portion with substantially smooth surfaces extending downward below the teeth.

43 Claims, 8 Drawing Sheets

U.S. PATENT DOCUMENTS

| | | | | |
|---|---|---|---|---|
| D146,998 | S | | 6/1947 | Townsend et al. |
| 2,524,537 | A | | 10/1950 | Osmonson |
| 2,573,467 | A | | 10/1951 | Macaluso |
| 2,583,784 | A | | 1/1952 | Maccaferri |
| 2,802,610 | A | | 8/1957 | DeLier |
| 2,883,095 | A | | 4/1959 | Greenbaum |
| D186,716 | S | | 7/1959 | Nalle, Jr. |
| 2,939,588 | A | | 6/1960 | Nalle, Jr. |
| 3,235,928 | A | | 2/1966 | Clark |
| D206,207 | S | | 11/1966 | Stein |
| 3,292,223 | A | | 12/1966 | Esposito, Jr. |
| 3,767,092 | A | | 10/1973 | Garrison et al. |
| 3,946,915 | A | | 3/1976 | Crane |
| 3,950,829 | A | | 4/1976 | Cohen |
| 3,973,705 | A | | 8/1976 | Erthein |
| D243,138 | S | | 1/1977 | Coon |
| 4,009,807 | A | | 3/1977 | Coon |
| 4,023,721 | A | | 5/1977 | Erthein |
| 4,123,864 | A | | 11/1978 | Batts et al. |
| 4,335,838 | A | | 6/1982 | Bisk et al. |
| 4,382,531 | A | | 5/1983 | Bisk et al. |
| 4,658,996 | A | | 4/1987 | Warmath |
| 4,660,750 | A | | 4/1987 | Blanchard |
| 4,706,347 | A | | 11/1987 | Lindsay |
| D296,729 | S | | 7/1988 | Blanchard |
| 4,759,480 | A | | 7/1988 | Duester et al. |
| 4,763,390 | A | | 8/1988 | Rooz |
| 4,802,265 | A | | 2/1989 | Stevenson |
| 5,075,935 | A | | 12/1991 | Abdi |
| 5,082,153 | A | | 1/1992 | Duester et al. |
| 5,178,306 | A | | 1/1993 | Petrou |
| 5,212,854 | A | | 5/1993 | Hollis |
| 5,297,706 | A | | 3/1994 | Blitz |
| 5,350,092 | A | | 9/1994 | Hollis |
| 5,361,948 | A | | 11/1994 | Batts |
| 5,398,854 | A | | 3/1995 | Blanchard |
| 5,400,932 | A | | 3/1995 | Hollis |
| 5,915,605 | A | | 6/1999 | Blanchard |
| 5,934,525 | A | | 8/1999 | Blanchard |
| 5,992,714 | A | | 11/1999 | Morgan |
| 6,019,261 | A | | 2/2000 | Morgan et al. |
| 6,021,933 | A | * | 2/2000 | Zuckerman ..... 223/96 |
| 6,050,461 | A | | 4/2000 | Batts et al. |

* cited by examiner

PINCH-GRIP HANGER

CROSS REFERENCE TO RELATED APPLICATION

This application is based on and claims benefit of U.S. Provisional Patent Application No. 60/281,454 filed Apr. 4, 2001 entitled PINCH HANGER, the disclosure of which is hereby incorporated by reference and to which a claim of priority is hereby made.

BACKGROUND OF THE INVENTION

1. Field of the Invention

The present invention relates to garment hangers and, more particularly, to garment hangers that are capable of displaying garments through the use of pinch-grips on each end of the hanger body.

2. Description of the Related Art Various types of pinch-hangers are known. These hangers include an attachment portion for securing the hanger body to a support (typically, a hook that secures the hanger body to a rod), and pinch-grips attached to the hanger body, typically at opposite ends thereof. Each pinch-grip includes a pair of vertically-extending gripping components, a mechanism for pivotally securing the components together, and a mechanism for biasing the bottom ends of the gripping components together. Typically, each gripping component has an upper end, a lower end and a central or connecting component portion between the ends. The bottom ends are configured and dimensioned to cooperatively receive and maintain a garment therebetween under the influence of the biasing mechanism. Preferably, the securing mechanism pivotably secures one connecting component portion to another connecting component portion.

To insert or remove a garment from the hanger, the upper ends of the gripping components are pressed together so that the components pivot relatively and the lower ends thereof separate. In this "open" or releasing orientation, the garment may be removed from or secured to the hanger. Finally, when the upper ends of the components are released, the biasing mechanism causes the components to pivot relatively and return to their original orientation with the upper ends spaced apart and the lower ends biased together. In this "closed" or gripping orientation, the garment may be suspended between the component bottom ends. If no article is between them, the component bottom ends may actually touch and abut, thereby to form an "abutting" orientation.

Such pinch-hangers are frequently used at retail stores to display garments suspended from the pinch-grips, such as a pair of pants, a skirt, or the like. In the optimal retail setting, the garment hangers (and the garments thereon) are sufficiently spaced from one another along a rod so that the pinch-grip components are not likely to undergo a re-orientation relative to one another as a result of pressure exerted thereon by an adjacent hanger or the clothing thereon. However, in fact, the garment hangers (and the garments thereon) are usually tightly pressed, one against the next, so as to put on display to potential customers the maximum number of garments. In this situation, the pinch-grips may open as result of the pressure exerted thereon by an adjacent hanger or by the clothing thereon. As a result, the clothing supported by the pinch-grip will fall to the floor.

Even where the hangers (and the garments thereon) are not crowded together along a rod when being displayed, they are typically crowded together during handling.

In particular, pinch-hangers are not well suited for use in the transport (shipping) of garments suspended from or attached to the pinch-grips. During such transport, for economic reasons, typically as many hangers (and the garments thereon) as possible will be forcibly pushed together (i.e., crowded) on a rod or like support (such as the loops of a looped rope, known as "a banana rope") or in a box. Even if the close pressing together of the hangers (either on a rod or loop or in a box) is by itself insufficient to cause the opening of a pinch-grip, the added forces conveyed to the pinch-grip during transport may be sufficient to open the same.

Thus, when garments are transported by various vehicles, abrupt starts-and-stops, turning or the like may result in a pinch-grip opening and losing the garment. Clearly this is highly undesirable as the garment falling completely or partially onto a floor may become ruined or may at least require pressing before it is ready to be displayed for sale. Likewise, labor costs are incurred in picking up the fallen garments during transport and reinserting them in the pinch-grip.

Attempts to solve these problems have sometimes resulted in creation of other problems. For example, some existing pinch-hangers have "bumpers" intended to prevent the components of the pinch-grip from being accidentally pressed. Some of these do prevent the pinch-grip from opening prematurely, but in some cases, these "bumpers" have shaped in a way that prevents comfortable access of fingers to the pressing surfaces of the upper portion, in particular larger fingers, thereby preventing the pinch-grip components from being intentionally pressed into a fully open position.

Other problems also exist in conventional pinch-hangers. For example, when garments are displayed or shipped using a pinch-hanger, the pivot area of each pinch-grip on the hanger typically has projections that leave creases or indentations in the portion of the garment proximal to the pivot area. These markings are caused because the pivot area is exposed between the bottom ends of the components comprising the pinch-grip. Also, handlers of the garments, be they employees or customers, typically force the garments as far as possible into the pinch-grip before closing it, thereby compounding the creasing problem.

Moreover, known pinch-hangers are, due to their design, restricted in their ability to accommodate and secure bulky garments having an enlarged waistband area such as denim jeans or pants having a belt provided.

Typically the bottom ends or gripping parts have "teeth" that are able to dig into the garment because the garments can be heavy and these "teeth" are required to effectively maintain a grip. Garment waistbands may also be thin and difficult to effectively grip. Because of this, various "teeth" configurations are used, all of which leave multiple markings on the garment that are undesirable.

The configuration of these gripper teeth can also interfere with the process of loading the garment into the pinch-grip. This is most often the case when the pinch-grip receives a thick garment that touches the teeth upon entry, or when the pinch-grip is not opened fully for some reason (for example, by not applying enough pressure on the upper end of the pinch-grip to force it into a fully open position).

Further, these teeth are typically point-shaped, i.e., angled on two sides and are arranged in multiple rows; i.e., staggered, which results in an unsightly pattern of marks on the garment. Moreover, it is found that pointed teeth are not always the most effective method for reliably holding a wide variety of fabrics. Further, the use of staggered teeth results in uneven pressure to the fabric, thereby causing stress on the fabric weave and resulting in puckering damage as well as undesirable indentation markings on the garment.

In addition, conventional biasing mechanisms used to maintain the pinch-glips closed are not entirely satisfactory. One known problem is that when the hangers are exposed to extreme temperatures (for example, in a shipping container), the plastic materials typically used for the hangers can soften and bend sufficiently to reduce the amount of pressure that the "teeth" can apply to the garment. Investigation has indicated that this is due, at least in part, to the fact that, in conventional designs, the biasing forces are not effectively directed toward the area of contact between the pinch-grip and the garment.

Thus, there exists a need for further improvements in the art for a hanger which can solve the above problems, by preventing the pinch-grips from opening due to contact with other hangers during shipment or display, by permitting reliable accommodation of bulky garments having an enlarged waistband area and by preventing garments from being "pinched" or creased in the pivot area of the pinch-grip so as to reduce garment gripper markings, while also providing enough spring pressure to secure the garment within the pinch-grip.

SUMMARY OF THE INVENTION

The pinch-grips according to the present invention preferably include a movable first gripping component and a stationary second gripping component pivotable relative to each other about a pivot axis. The gripping components are in the form of opposed front and back legs, and each leg includes a lower end below the pivot axis for receiving a garment and upper end above the pivot axis which can be pressed together to open the hanger. The lower ends of the legs are preferably substantially identical to each other in that they each include a single gripping portion having gripping teeth which contact each other when a garment is not present within the pinch-grip. Each pinch-grip also includes an inverted U-shaped spring which biases the lower ends of the legs together and allows separation of the lower ends of the legs towards a fully extended open position when upper ends of the legs are pinched together. The spring has legs which are anchored to the legs of the pinch grip and are displaced from their respective rest positions so that the resulting restoring force therein provides the biasing force for the pinch grip. The ends of spring legs engage the pinch grip legs in a manner such that the biasing force is applied substantially toward the area in which the gripping portions engages a garment held by the hanger.

Each pinch-grip also preferably includes spacers or "bumpers" on each side thereof which extend outwardly from the back leg towards the front leg. These protectors prevent the accidental opening of the pinch-grip by providing a hanger-to-hanger minimum spacing while still enabling the intentional movement of the pinch-grip into the fully extended open position.

In a preferred embodiment, the legs include, on the opposed surfaces thereof, vertically offset wall sections which extend in back-to-front overlapping relationship from the inner surface of each of the pinch-grip components and are located below to the pivot area of the pinch-grip. The opposed wall sections cooperate to form a barrier that prevents the garment from being pinched within the pivot area of the pinch-grip. In addition the upper portions of the front legs are angled relative to the lower portions to facilitate full opening when the upper portions of the front and back legs are pressed together. The angle is such that the upper portions of the legs do not become parallel to each other until the bottom ends have been separated as far as possible.

These aspects and advantages of the present invention, as well as others, will become apparent from the following description of the preferred embodiments which refer to the accompanying drawings.

BRIEF DESCRIPTION OF THE DRAWINGS

For the purpose of illustrating the invention, there is shown in the drawings a form which is presently preferred, it being understood, however, that the invention is not limited to the precise arrangements and instrumentalities shown.

DETAILED DESCRIPTION OF EMBODIMENTS OF THE INVENTION

Figure 1:
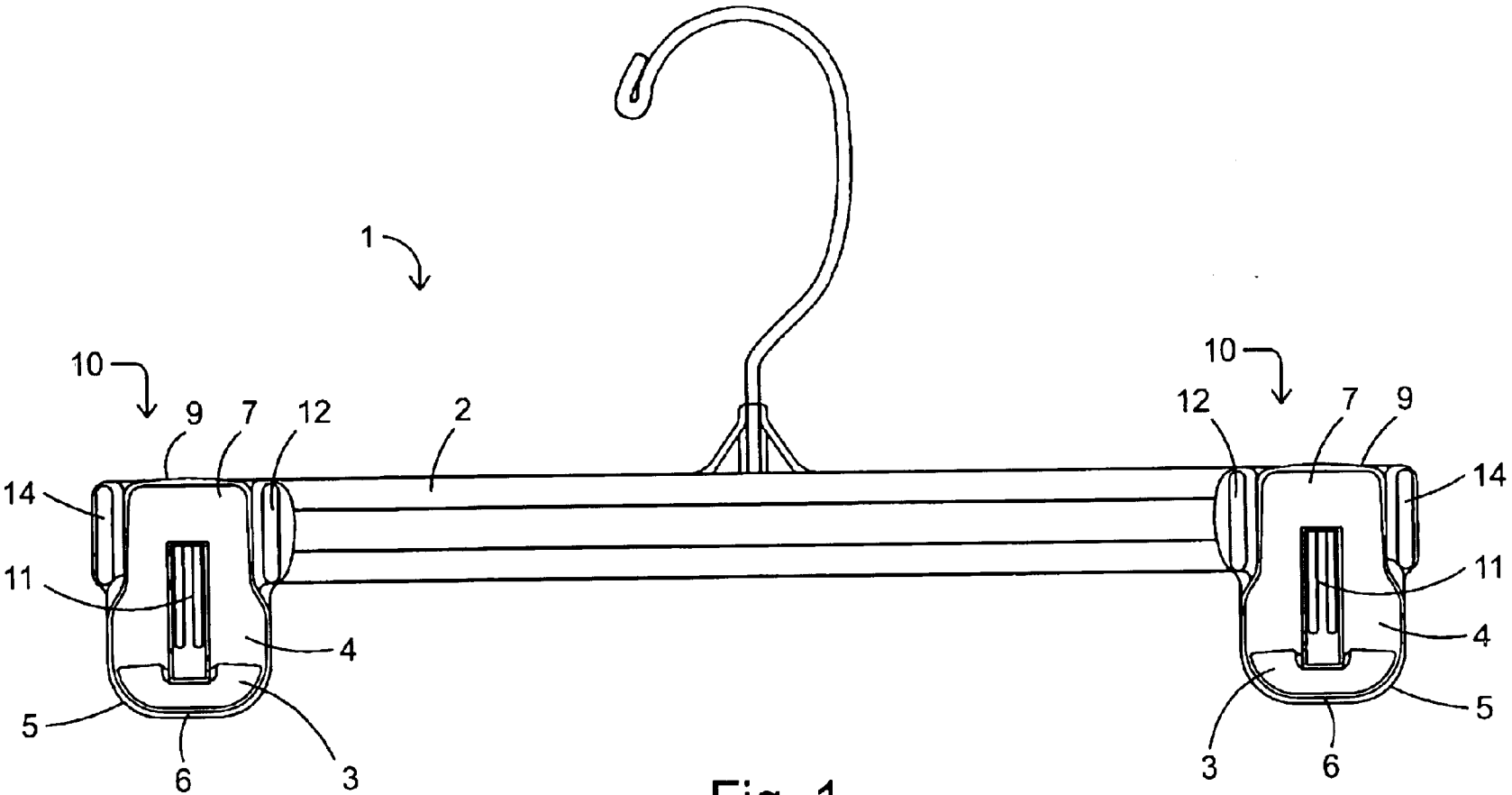
FIG. 1 is a front elevation view of a hanger in accordance with the first embodiment of the present invention.
Figure 2:
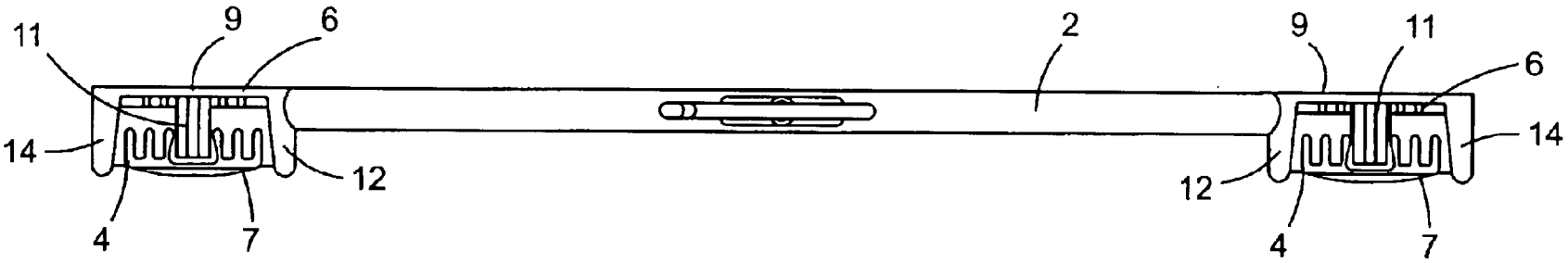
FIG. 2 is a top plan view of the hanger shown in FIG. 1.
Figure 3:
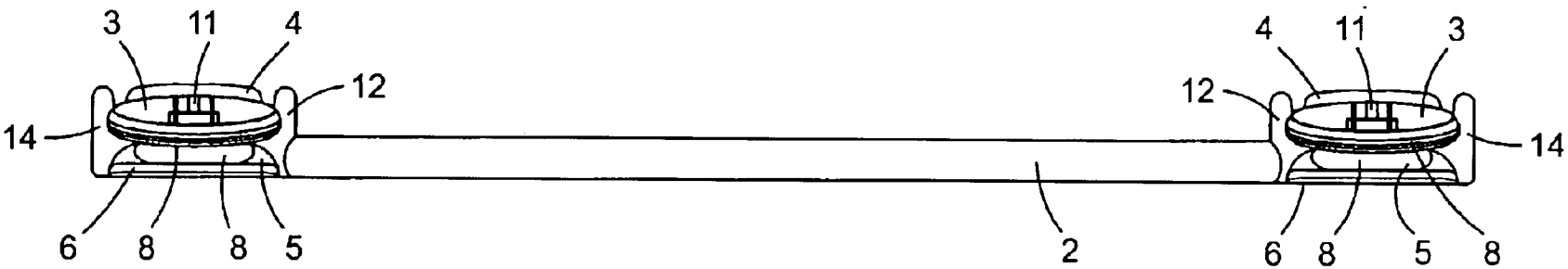
FIG. 3 is a bottom plan view of the hanger shown in FIG. 1.

Referring to FIGS. 1–7, wherein like reference numerals indicate like elements, there is shown a garment hanger in accordance with a first embodiment of the present invention. The garment hanger shown can be made from any suitable known material and by any suitable known method. Preferably, the garment hanger is made of injection molded plastic.

As shown in FIG. 1, the pinch-hanger 1 includes a pinch-grip 10 on each end of a hanger body 2. Each pinch-grip 10 includes a movable first gripping component or leg 4 and a stationary second gripping component or leg 6 secured to each other about a pivot axis. Each of components 4 and 6 includes respective lower ends 3, and 5 below the pivot axis for receiving a garment therebetween and respective upper ends 7 and 9 above the pivot axis. The upper ends 7 and 9 are preferably sized, in this first embodiment, to be substantially equal in length to their respective lower ends 3 and 5. This "long-lever engineering" allows for easier opening of the pinch-grip, or reduced opening pressure, while still providing a firm, secure grip on the garment.

Figure 6:
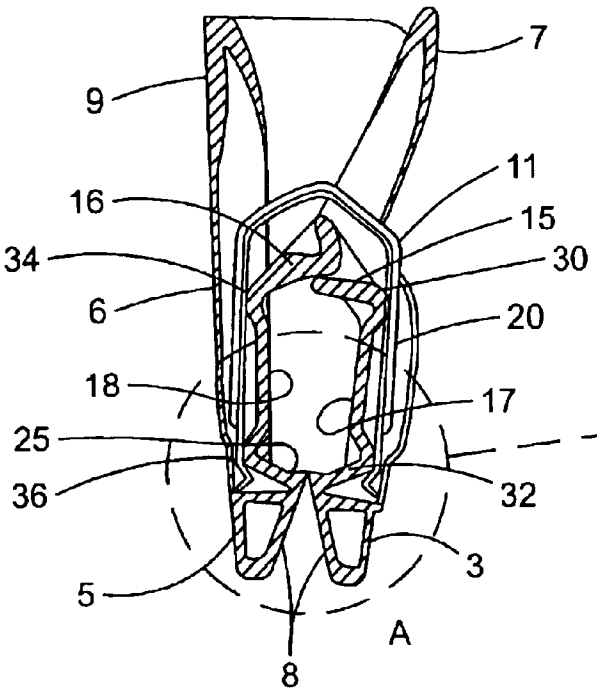
FIG. 6 is a cross sectional view of the pinch-grip shown in FIG. 5.
Figure 8:
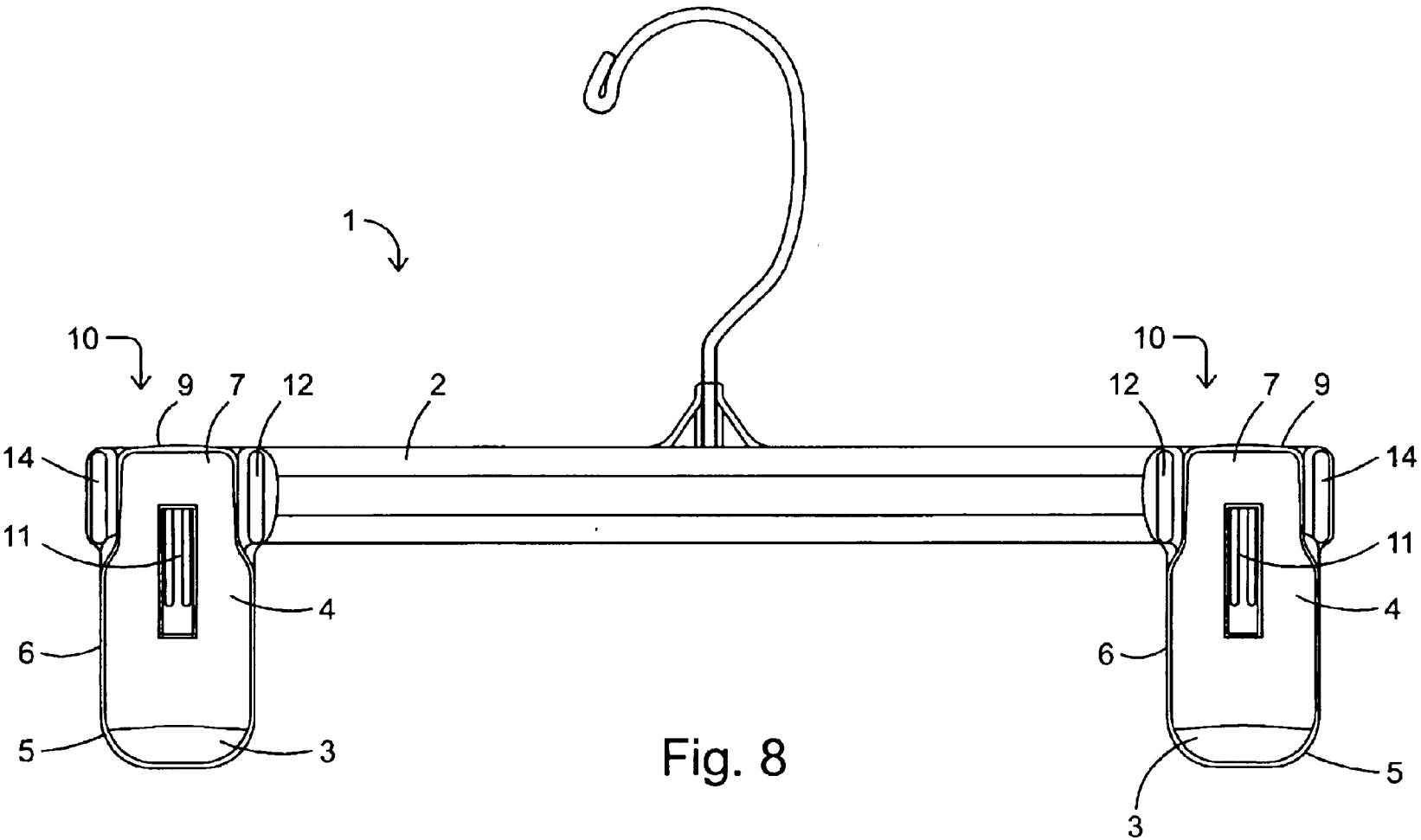
FIG. 8 is a front elevation view of a hanger in accordance with a second embodiment of the invention.
Figure 9:
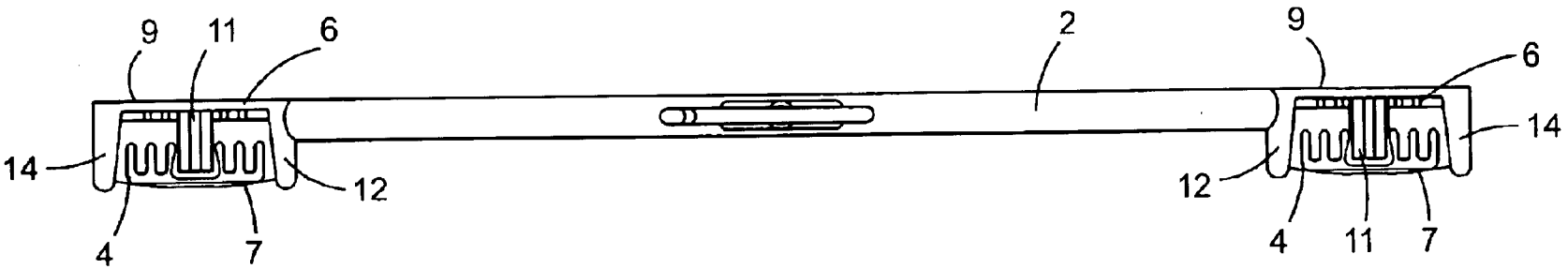
FIG. 9 is a top plan view of the hanger shown in FIG. 8.
Figure 10:
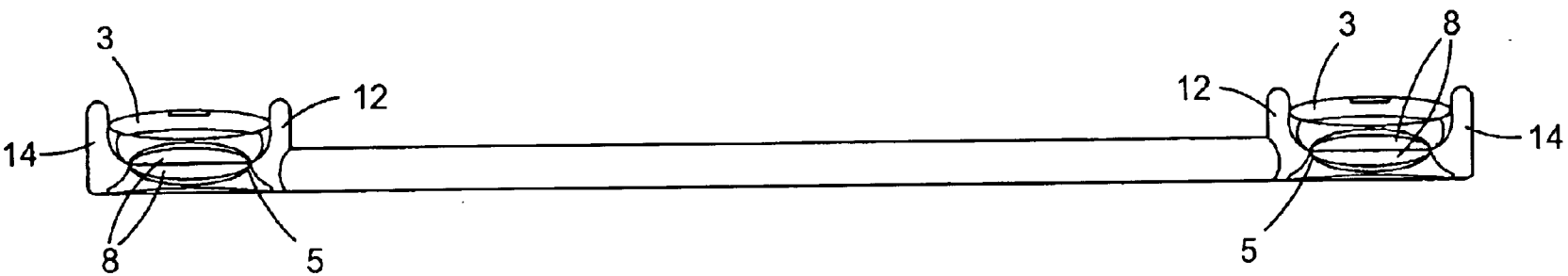
FIG. 10 is a bottom plan view of the hanger shown in FIG. 8.
Figure 12:
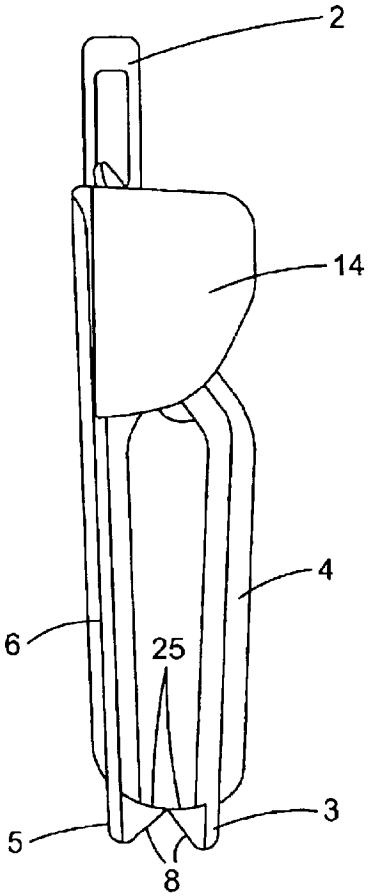
FIG. 12 is a side elevation view of one of the pinch-grips of FIG. 8 shown in the closed position.
Figure 11:
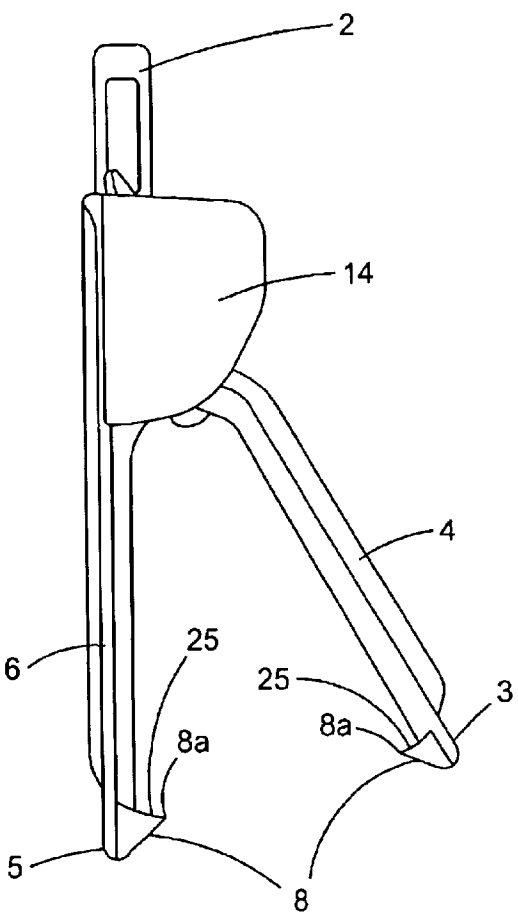
FIG. 11 is a side elevation view of one of the pinch-grips shown in FIG. 8 in the open position.
Figure 14:
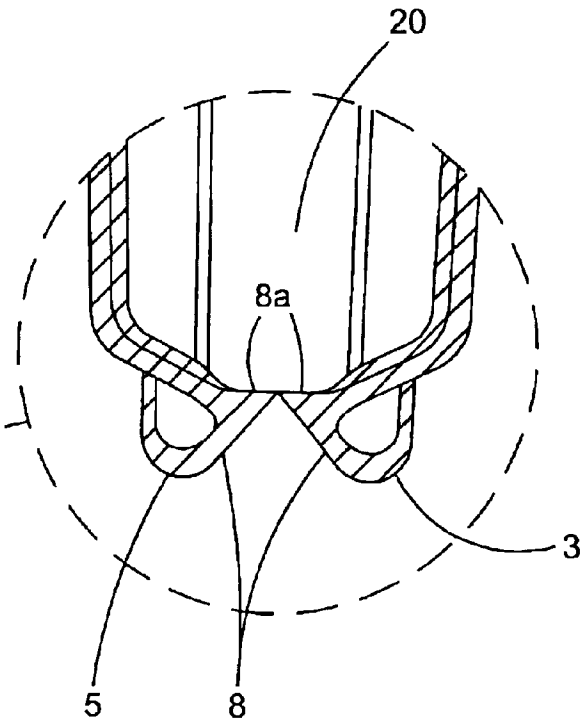
FIG. 14 is an enlarged view of section B of FIG. 13.
Figure 13:
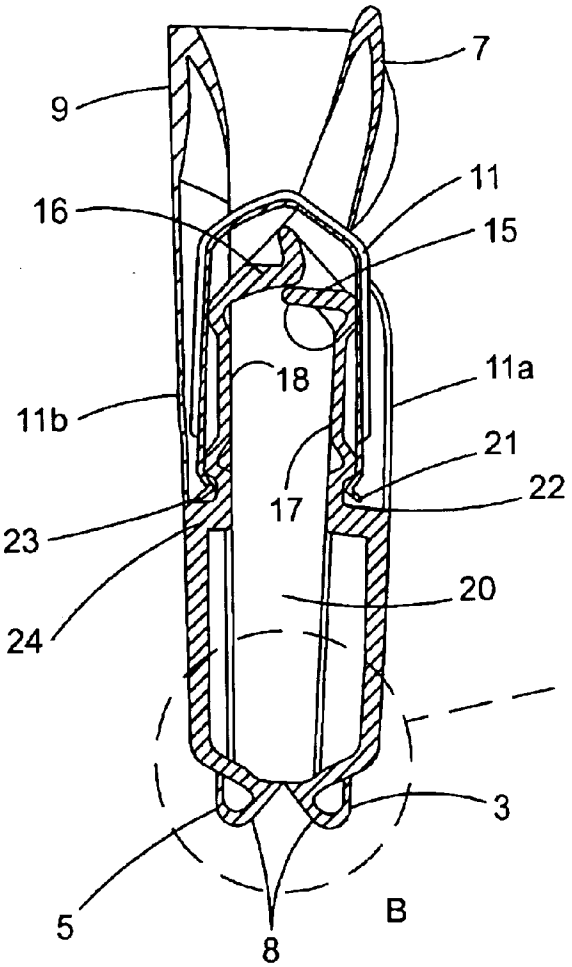
FIG. 13 is a cross sectional view of one of the pinch-grips shown in FIG. 12.

Also, as shown in FIG. 6, the upper end 7 of the front leg 4 is preferably angled outwardly relative to the upper end 9 of the back leg 6. Outward angling of the upper end 7 of leg 4 enables a greater separation between the lower ends of the legs by providing a greater distance through which the upper end 7 travels before contact with the upper end 9.

Outward angling of the front leg can also make the pinch-grip easier to handle by preventing the premature release of the components when the upper end 7 of front leg 4 becomes parallel to the upper end 9 of rear leg 6. This is achieved by angling the upper end 7 outwardly with respect to the upper end 9 sufficiently that the upper ends 7 and 9 are not parallel to each other until the pinch grip is substantially in the fully open position.

The respective lower ends 3 and 5 of legs 4 and 6 are preferably substantially identical to each other and include a single opposed gripping portion 8 (FIGS. 3–7) which contacts the other when a garment is not present within the pinch-grip. Each gripping portion 8 includes a laterally disposed gripping tooth 8*a*. Each pinch-grip also includes a U-shaped spring 11 which biases the lower ends 3 and 5 of the legs together and allows separation towards a fully extended open position (FIG. 4) by relative movement of the upper parts of legs 4 and 6.

Figure 5:
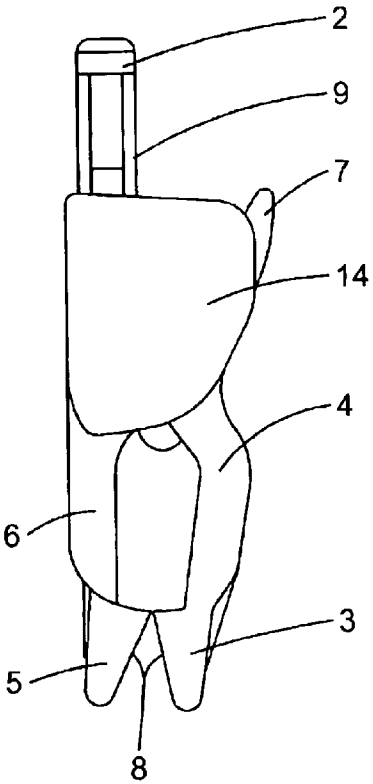
FIG. 5 is a side elevation view of one of the pinch-grips of FIG. 1 shown in the closed position.
Figure 4:
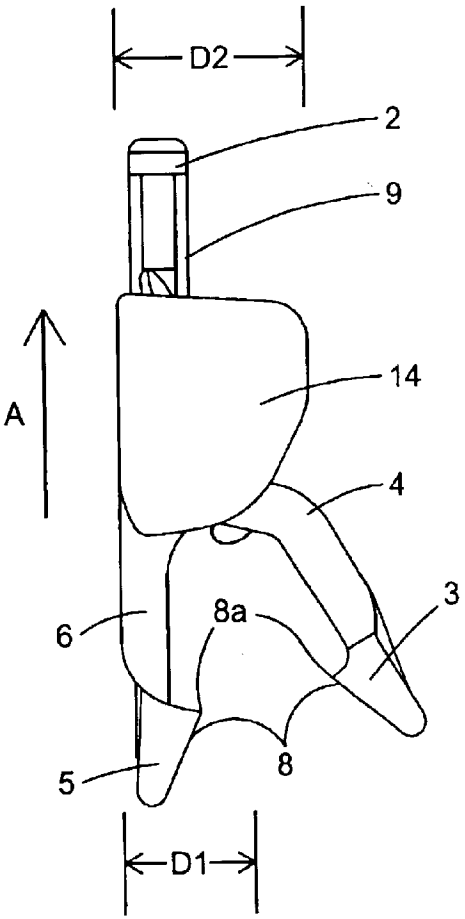
FIG. 4 is a side elevation view of one of the pinch-grips shown in FIG. 1 in the open position.

To insert or remove an article from the pinch-grip 10, the upper ends 7 and 9 are pressed together so that the front leg 4 pivots about the pivot axis and the lower ends 3 and 5 separate. In this "open" position (FIG. 4), the garment may be placed in or removed from the lower end of the pinch-grip. When the upper ends 7 and 9 of the legs are released, the U-shaped spring 11 causes the lower ends 3 and 5 of the components to return to a "closed" position, as shown in FIG. 5.

Each pinch-grip 10 includes protectors or "bumpers" 12 and 14 at opposite ends thereof along hanger body 2. Bumpers 12 and 14 extend outwardly from the back leg 6 toward the front leg 4. Protectors 12 and 14 are designed to prevent the accidental opening of the pinch-grip 10 without preventing the intentional movement of the pinch-grip 10 into the fully extended open position of FIG. 4.

As shown in FIGS. 4–7, the inner protector 12 is substantially identical to the outer protector 14. When placed in a normal hanging position, each of the protectors, at its lower end, initially extends outwardly to a first distance D1 from the hanger body 2. As measured while continuing along the vertical path of the protector as indicated by the arrow A, the distance that the protector extends from the hanger body 2 continually increases until reaching a second distance D2. Thereafter, while continuing along the vertical path of the protector, the distance D2 that the protector extends from the hanger body remains substantially constant until reaching the top edge of the hanger body where the protector terminates at distance D2.

Also as illustrated in FIGS. 1–6 when the pinch grip is closed, and no garment is being held, the far end 7*a* of upper leg portion 7 protrudes slightly beyond the confines of the area between protectors 12 and 14, i.e., a distance from the back of the hanger slightly greater than distance D2. This, of course, is the maximum protrusion; when a garment is being held, the lower portion 3 of leg 4 is displaced (to the right in FIG. 5) and the top of leg 4 is displaced rearwardly (i.e., to the left) so that it no longer protrudes beyond the front of protectors 12 and 14. This prevents the pinch grip from opening due to contact with an adjacent hanger on a rack.

However, the tip 7*a* of upper leg portion 7 still protrudes upwardly beyond the space between bumpers 12 and 14, and moreover, the spacing between the bumpers exceeds the width of even a large finger. This design provides for easy and comfortable access of fingers to the respective upper ends 7 and 9 of legs 4 and 6 to open the pinch grip.

As shown in FIG. 6, legs 4 and 6 include opposed, offset wall sections 15 and 16 which extend inwardly from the inner surfaces 17 and 18 and are located proximal to but just below the pivot area of the pinch-grip such that the garment is prevented from being pinched within the pivot area of the pinch-grip. These opposed inwardly projecting wall sections 15 and 16 overlap transversely in the front-to-back direction and cooperate to form a barrier within the gripping area 20 of the pinch-grip that prevents the garment from being pinched by the pivot area during the opening and closing of the components. Basically, the opposed wall sections 15 and 16, regardless of the open or closed position of the pinch-grip, shield the garment from contact with the pivot area, as the overlapping relationship illustrated in FIG. 6 is maintained whether the pinch grip is open or closed.

Figure 7:
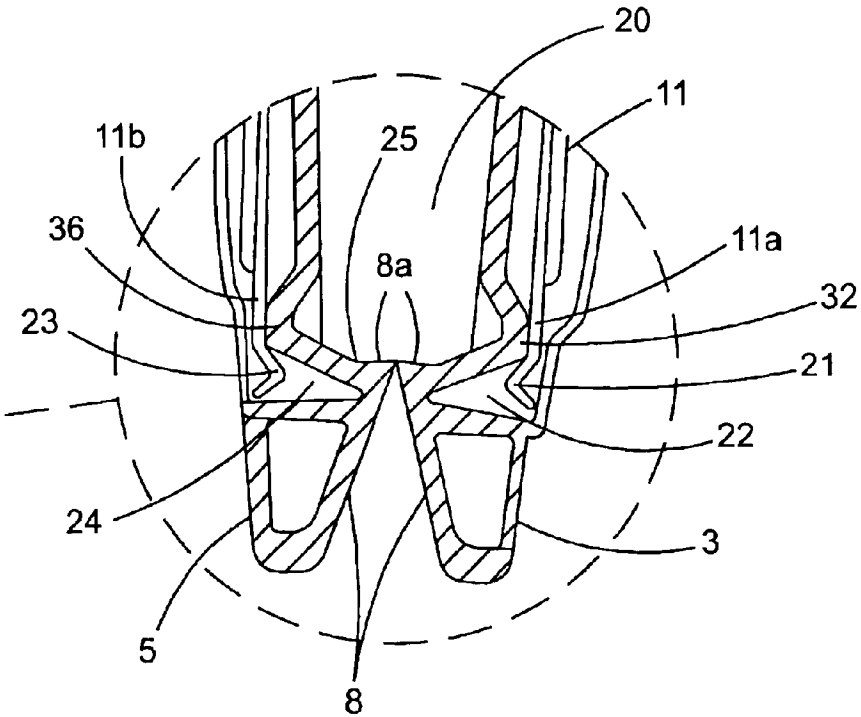
FIG. 7 is an enlarged view showing section A of FIG. 6.

Also, as shown in FIG. 7, the respective lower ends 3 and 5 of legs 4 and 6 include single gripping portion 8 having gripping teeth 8*a*. These single gripping portions 8 and gripping teeth 8*a* interact so as to reduce the gripper markings on the garment placed within the pinch-grip. As shown in FIG. 7, the gripping portions 8 are preferably inclined inwardly (i.e. outwardly tapered), from the respective lower ends 3 and 5 of legs 4 and 6 towards the upper ends 7 and 9. This allows for easier garment loading within the pinch-grip by providing a gradual transition or "ramp" from the bottom edge of the pinch-grip components into the gripping area 20.

Further, the inclined surfaces of the gripping portions 8 are preferably provided with a smooth finish over their entire surfaces such that, when a garment contacts the "ramp" as it is being placed within the pinch-grip, it easily and smoothly slides into place without interference. Moreover, this action promotes the compression of bulky garments so as to facilitate their entry into the gripping portion of the pinch-grip.

Additionally, and as shown in FIGS. 6 and 7, the tops of gripping teeth 8*a* preferably form substantially flat surface 25, perpendicular with respect to the vertical axis of the pinch-grip. Flat surfaces 25 preferably lie at an angle in the range of about 10° above and below the horizontal axis of the pinch-grip, and are most preferably approximately horizontal. These surfaces 25 reduce garment slip and help retain the garment in place within the pinch-grip by gripping under the garment folds or stitching lines, as opposed to typical "teeth" which have upper surfaces which are angled downwardly between 30° and 45°, thereby allowing the garment to "slip" from the pinch-grip easily.

Moreover, the use of the single gripping portions 8 and gripping teeth 8*a* in conjunction with the substantially flat surfaces 25 allows for the formation of a cavity or "free space" within the gripping area 20. This "free space" allows for the accommodation of bulkier or thicker garments within the pinch-grip while also accommodating traditional sized garments, thereby providing a punch grip having improved versatility.

The U-shaped spring 11, as shown in FIGS. 6 and 7 is preferably designed to apply pressure directly behind the gripping portion 8, and preferably, directly behind the gripping teeth 8*a* by engagement with respective projections 32 and 36 on the lower ends 3 and 5 of components 4 and 6 in opposed relationship to gripping teeth 8*a*. Each leg 11*a* and 11*b* of the U-shaped spring 11 extends and terminates at substantially the same location as the gripping surface 8.

Preferably, to retain the spring 11 in place during the opening and closing of the pinch-grip, legs 4 and 6 are provided with respective recessed areas 22 and 24, and legs 11*a* and 11*b* of the U-shaped spring 11 are provided with complementary hook-shaped portion 21 and 23 which fit below projections 32 ad 36. The hook-shaped portions 21 and 23 of the legs 11*a* and 11*b* of the spring 11 seat within the associated recessed areas 22 and 24 and retain the spring 11 in place on the pinch-grip during the opening and closing thereof. Positioning of the spring 11 to apply pressure at the gripping surface 8, and preferably at the gripping teeth 8*a*, substantially decreases the tendency of the pinch-grip components to undergo plastic deformation when exposed to increased temperatures which may be encountered during shipping and storage of the hangers, with or without garments attached thereto.

Additional projections 30 and 34 on the middle portions of legs 4 and 6 may be used engage the opposed legs of spring clip 11 near the top thereof to assure proper positioning of the spring clip during operation.

Referring now to FIGS. 8 through 14, a second embodiment of the pinch-hanger is disclosed. In this embodiment, the lower ends 3 and 5 of the pinch-grips legs 4 and 6 are extended, or elongated below the point at which the biasing force is applied by spring 11, to allow the pinch-grips to grab difficult to hang garments with enlarged waistbands or waistbands with a belt fitted thereto. This lengthening of the gripping space 20 permits the gripping teeth 8*a* to engage the garment below the stitching line of the waistband area. With this, the gripping portion 8 and gripping teeth 8*a* grab below the thicker waistband and hold the bulky garment very securely.

Longer springs may be fitted to also provide pressure behind the gripping teeth. This may not be necessary as gripping underneath the step provided by the waistband requires less pressure than is required normally.

All other components described above with reference to the first embodiment of FIGS. 1–7, and having the same reference numerals in FIGS. 8–14, are similar to those described above and their description and operation are incorporated into this description of the second embodiment as if fully set forth.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A pinch-grip hanger including:

an elongated body; and a first and second pinch-grips positioned along the body, each of the pinch-grips being comprised of:

a first leg having an upper and a lower end;

a second leg having an upper and a lower end, the first and second legs being in opposed front-to-back relationship;

gripping portions at the lower ends of the first and second legs;

a biasing mechanism that applies a force which is directed substantially solely toward the gripping portions to bias the gripping portions toward each other;

the upper ends of the legs being relatively movable toward each other about a pivot axis to separate the gripping portions, and thereby to open the pinch-grip, the upper ends of the legs being separated in a rest position by a front-to-back distance depending on the thickness of an item held by the hangar, and having a maximum front to back separation when an item is not being held by the hanger;

first and second spacers at opposite sides of the first and second legs extending in the front-to-back direction, the spacers having a maximum front-to-back dimension relative to the maximum front-to-back separation distance of the upper ends of the legs such that contact with another hanger on a rack will not move the upper ends of the legs toward each other a sufficient distance to release an item being held by the gripping portions and opposed barriers extending toward each other from the first and second legs, the barriers being located below the pivot axis, in vertically spaced, and front to back overlapping relationship when the pinch grip is used, and remaining in overlapping relationship when the pinch grip is open or closed, the barriers forming the upper end of a griping area between the gripping portions and shielding an item held by the hanger from the area near the pivot axis.

2. A pinch-grip hanger according to claim 1, wherein each of the gripping portions include:

a single gripping tooth elongated in the direction of the pivot axis, and extending toward the tooth on the other gripping portion with the tips thereof substantially in contact when the pinch grip is closed and an item is not being held by the hanger, substantially flat upper surfaces on each tooth that together define a lower end of the gripping area between the gripping portions; and an outwardly tapering end portion having a substantially smooth surface extending downward below the teeth.

3. A pinch-grip hanger according to claim 1, wherein each of the gripping portions include:

a single gripping tooth elongated in the direction of the pivot axis, and extending toward the tooth on the other gripping portion with the tips thereof substantially in contact when the pinch grip is closed and an item is not being held by the hanger, substantially flat upper surfaces on each tooth that together define a lower end of the garment gripping area between the gripping portions; and an outwardly tapering end portion having a substantially smooth surface extending downward below the teeth.

4. A pinch-grip hanger according to claim 1, wherein the first legs are fixed relative to the hanger body, and the second legs are pivotable relative to the respective first legs.

5. A pinch-grip hanger according to claim 4, wherein the first legs are positioned behind the second legs.

6. A pinch-grip hanger according to claim 1, wherein the gripping portions are in contact when an item is not being held by the hanger.

7. A pinch-grip hanger according to claim 1, wherein the upper ends of the first and second legs of each pinch-grip are located between the respective spacers for the pinch-grip with distal portions thereof projecting above the tops of the spacers.

8. A pinch-grip hanger according to claim 1, wherein the maximum front-to-back dimension of the spacers is approximately equal to the maximum separation of the upper ends of the legs.

9. A pinch-grip hanger according to claim 1, wherein the pivot axes of the pinch-grips are located approximately at the mid points of the respective legs thereof.

10. A pinch-grip hanger according to claim 1, wherein the portions of the first and second legs below the pivot axes are substantially longer than the portions above the pivot axes.

11. A pinch-grip hanger according to claim 1, wherein the upper portion of one of the legs of each pinch-grip is angled outwardly relative the lower portion thereof.

12. A pinch-grip hanger according to claim 11, wherein the configuration of the upper and lower ends of the angled leg is such that the upper ends of the legs are not parallel unless the pinch-grip mechanism is substantially in its fully open position.

13. A pinch-grip hanger according to claim 1, wherein the biasing forces are directed substantially toward the areas in which the gripping portions of the legs engage an item being held by the hanger.

14. A pinch-grip hanger according to claim 13, wherein:

the biasing mechanisms are comprised of inverted U-shaped springs having legs thereof anchored to the gripping portions;

the spring legs are displaced from respective rest positions by oppositely extending projections on the legs of the pinch grips; and restoring forces due to the displacement of the spring legs is operative to bias the gripping portions of the pinch grip legs toward each other.

15. A pinch-grip hanger including:

an elongated body; and first and second pinch-grips positioned along the body, each of the pinch-grips being comprised of:

a first leg having an upper and a lower end;

a second leg having an upper and a lower end, the first and second legs being in opposed front-to-back relationship;

gripping portions at the lower ends of the first and second legs;

a biasing mechanism that applies a force near the first ends of the first and second legs to bias the gripping portions thereof toward each other;

the upper ends of the legs being movable toward each other about a pivot axis to separate the gripping portions, and thereby to open the pinch-grip, opposed barriers extending toward each other from the first and second legs, the barriers being located below the pivot axis, in vertically spaced, and front-to-back overlapping relationship when the pinch-grip is closed, and remaining in overlapping relationship when the pinch-grip is opened, the barriers forming the upper end of an item gripping area between the gripping portions and shielding an item held by the hanger from the area near the pivot axis.

16. A pinch-grip hanger according to claim 15, wherein each of the gripping portions include:

a single gripping tooth elongated in the direction of the pivot axis, and extending toward the tooth on the other gripping portion with the tips thereof substantially in contact when the pinch-grip is closed and an item is not being held by the hanger, substantially flat upper surfaces on each tooth that together define a lower end of the gripping area between the gripping portions; and an outwardly tapering end portion having a substantially smooth surface extending downward below the teeth.

17. A pinch-grip hanger according to claim 15, wherein the first legs are fixed relative to the hanger body, and the second legs are pivotable relative to the respective first legs.

18. A pinch-grip hanger according to claim 17, wherein the first legs are positioned behind the second legs.

19. A pinch-grip hanger according to claim 15, wherein the opposed gripping portions are in contact when an item is not being held by the hanger.

20. A pinch-grip hanger according to claim 15, wherein the pivot axes of the pinch-grips are located approximately at the mid points of the respective legs thereof.

21. A pinch-grip hanger according to claim 15, wherein the portions of the first and second legs below the pivot axes are substantially longer than the portions above the pivot axes.

22. A pinch-grip hanger according to claim 15, wherein the upper portion of one of the legs of each pinch-grip is angled outwardly relative the lower portion thereof.

23. A pinch-grip hanger according to claim 22, wherein the configuration of the upper and lower ends of the angled legs is such that the upper ends of the legs are not parallel unless the pinch-grip is substantially in its fully open position.

24. A pinch-grip hanger according to claim 15, wherein the biasing forces are directed substantially toward the areas in which the gripping portions of the legs engage an item being held by the hanger.

25. A pinch-grip hanger according to claim 24, wherein:

the biasing mechanisms are comprised of inverted U-shaped springs having legs thereof anchored to the gripping portions;

the spring legs are displaced from respective rest positions by oppositely extending projections on the legs of the pinch grips; and restoring forces due to the displacement of the spring legs is operative to bias the gripping portions of the pinch grip legs toward each other.

26. A pinch-grip hanger including:

an elongated body; and first and second pinch-grips positioned along the body, each of the pinch-grips being comprised of:

a first leg having an upper and a lower end;

a second leg having an upper and a lower end;

the first and second legs being in opposed front-to-back relationship a single gripping portion at the lower end of each of the first and second legs; and a biasing mechanism that applies a force near the first ends of the first and second legs to bias the gripping portions thereof toward each other;

the upper ends of the legs being relatively movable toward each other about a pivot axis to separate the gripping portions, and thereby to open the pinch-grip; each of the gripping portions including:

a single gripping tooth elongated in the direction of the pivot axis, and extending toward the tooth on the other gripping portion with the tips thereof substantially in contact when the pinch grip is closed and an item is not being held by the hanger;

substantially flat upper surfaces on each tooth that together define a lower end of a garment gripping area between the gripping portions; and an outwardly tapering end portion having a substantially smooth surface extending downward below the teeth.

27. A pinch-grip hanger according to claim 26, wherein the first legs are fixed relative to the hanger body, and the second legs are pivotable relative to the respective first legs.

28. A pinch-grip hanger according to claim 27, wherein the first legs are positioned behind the second legs.

29. A pinch-grip hanger according to claim 26, wherein the pivot axes of the pinch-grips are located approximately at the mid points of the respective legs thereof.

30. A pinch-grip hanger according to claim 26, wherein the portions of the first and second legs below the pivot axes are substantially longer than the portions above the pivot axes.

31. A pinch-grip hanger according to claim 26, wherein the upper portion of one of the legs of each pinch-grip is angled outwardly relative the lower portion thereof.

32. A pinch-grip hanger according to claim 31, wherein the configuration of the upper and lower ends of the angled legs is such that the upper ends of the legs are not parallel unless the pinch-grip is substantially in its fully open position.

33. A pinch-grip hanger according to claim 26, wherein the biasing forces are directed substantially toward the gripping teeth.

34. A pinch-grip hanger according to claim 33, wherein:

the biasing mechanisms are comprised of inverted U-shaped springs having legs thereof anchored to the gripping portions;

the spring legs are displaced from respective rest positions by oppositely extending projections on the legs of the pinch grips; and restoring forces due to the displacement of the spring legs is operative to bias the gripping portions of the pinch grip legs toward each other.

35. A pinch grip hanger according to claim 26, wherein the upper surfaces of each tooth lie in planes that are in the range of approximately 10° above and below horizontal.

36. A pinch grip hanger according to claim 35, wherein the upper surfaces of each tooth lie in planes which are approximately horizontal.

37. A pinch grip hanger according to claim 3, wherein the upper surfaces of each tooth lie in planes that are in the range of approximately 10° above and below horizontal.

38. A pinch grip hanger according to claim 37, wherein the upper surfaces of each tooth lie in planes which are approximately horizontal.

39. A pinch-grip hanger including:

an elongated body; and first and second pinch-grips positioned along the body, each of the pinch-grips being comprised of:

a first leg having an upper and a lower end;

a second leg having an upper and a lower end, the first and second legs being in opposed front-to-back relationship;

gripping portions at the lower ends of the first and second legs;

a biasing mechanism that applies a force near the lower ends of the first and second legs to bias the gripping portions thereof toward each other;

the upper ends of the legs being relatively movable toward each other about a pivot axis to separate the gripping portions, and thereby to open the pinch-grip, the upper ends of the legs being separated in a rest position by a front-to-back distance depending on the thickness of an item held by the hangar, and having a maximum front to back separation when an item is not being held by the hanger;

first and second spacers at opposite sides of the first and second legs extending in the front-to-back direction, the spacers having a maximum front-to-back dimension relative to the maximum front-to-back separation distance of the upper ends of the legs such that contact with another hanger on a rack will not move the upper ends of the legs toward each other a sufficient distance to release an item being held by the gripping portions; and opposed barriers extending toward each other from the first and second legs, the barriers being located below the pivot axis, in vertically spaced, and front-to-back overlapping relationship when the pinch grip is used, and remaining in overlapping relationship when the pinch-grip is open or closed, the barriers forming the upper end of a gripping area between the gripping portions and shielding an item held by the hanger from the area near the pivot axis.

40. A pinch-grip hanger according to claim 39, wherein each of the gripping portions include:

a single gripping tooth elongated in the direction of the pivot axis, and extending toward the tooth on the other gripping portion with the tips thereof substantially in contact when the pinch grip is closed and an item is not being held by the hanger, substantially flat upper surfaces on each tooth that together define a lower end of the gripping area between the gripping portions; and an outwardly tapering end portion having a substantially smooth surface extending downward below the teeth.

41. A pinch-grip hanger including:

an elongated body; and first and second pinch-grips positioned along the body, each of the pinch-grips being comprised of:

a first leg having an upper and a lower end;

a second leg having an upper and a lower end, the first and second legs being in opposed front-to-back relationship;

gripping portions at the lower ends of the first and second legs;

a biasing mechanism that applies a force near the lower ends of the first and second legs to bias the gripping portions thereof toward each other;

the upper ends of the legs being relatively movable toward each other about a pivot axis to separate the gripping portions, and thereby to open the pinch-grip, the upper ends of the legs being separated in a rest position by a front-to-back distance depending on the thickness of an item held by the hangar, and having a maximum front to back separation when an item is not being held by the hanger; and first and second spacers at opposite sides of the first and second legs extending in the front-to-back direction, the spacers having a maximum front-to-back dimension relative to the maximum front-to-back separation distance of the upper ends of the legs such that contact with another hanger on a rack will not move the upper ends of the legs toward each other a sufficient distance to release an item being held by the gripping portions, wherein each of the gripping portions include:

a single gripping tooth elongated in the direction of the pivot axis, and extending toward the tooth on the other gripping portion with the tips thereof substantially in contact when the pinch grip is closed and an item is not being held by the hanger, substantially flat upper surfaces on each tooth that together define a lower end of the garment gripping area between the gripping portions; and an outwardly tapering end portion having a substantially smooth surface extending downward below the teeth.

42. A pinch grip hanger according to claim 41, wherein the upper surfaces of each tooth lie in planes that are in the range of approximately 10° above and below horizontal.

43. A pinch grip hanger according to claim 42, wherein the upper surfaces of each tooth lie in planes which are approximately horizontal.

* * * * *